US006088926A

United States Patent [19]

Steiner et al.

[11] Patent Number: 6,088,926

[45] **Date of Patent: *Jul. 18, 2000**

[54] DRYER SECTION

[75] Inventors: Karl Steiner, Herbrechtingen; Karlheinz Straub, Heidenheim; Robert Wolf, Herbrechtingen; Albrecht Meinecke; Tri Chau-Huu, both of Heidenheim; Markus Oechsle, Bartholomae, all of Germany

[73] Assignee: Voith Sulzer Papiermaschinen GmbH, Heidenheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/946,645

[22] Filed: Oct. 7, 1997

[30] Foreign Application Priority Data

Oct. 15, 1996 [DE] Germany ..... 196 42 526

[51] Int. Cl.[7] ..... D21F 5/00

[52] U.S. Cl. ..... 34/117

[58] Field of Search ..... 34/114, 116, 117, 34/118, 120

[56] References Cited

U.S. PATENT DOCUMENTS 3,354,035 11/1967 Gottwald et al. ..... 34/118
4,513,517 4/1985 Vedenpää ..... 34/114
4,622,758 11/1986 Lehtinen et al. ..... 34/116
5,778,555 7/1998 Lehtinen et al. ..... 34/116

FOREIGN PATENT DOCUMENTS 2184820 7/1987 United Kingdom .

OTHER PUBLICATIONS

German Search Report dated Apr. 01, 1997, performed in German Patent Application No. 196 42 526.3.

*Primary Examiner*—Henry Bennett
*Assistant Examiner*—Steve Gravini
*Attorney, Agent, or Firm*—Greenblum & Bernstein, P.L.C.

[57] ABSTRACT

Dryer section of a machine for manufacturing a material sheet. The dryer section may include at least one dryer cylinder, a plurality of sheet guide rolls, a transport belt for guiding the material sheet in a meandering manner around the at least one dryer cylinder and the plurality of sheet guide rolls, and threads surrounding at least one of the at least one dryer cylinder and the plurality of sheet guide rolls. The threads may be positioned between the material sheet and a surface of the at least one of the at least one dryer cylinder and the plurality of sheet guide rolls.

31 Claims, 1 Drawing Sheet

DRYER SECTION

CROSS-REFERENCE OF RELATED APPLICATION

The present application claims priority under 35 U.S.C. §119 of German Patent Application No. 196 42 526.3 filed Oct. 15, 1996.

BACKGROUND OF THE INVENTION

1. Field of the Invention

The present invention relates to a dryer section of a machine to manufacture a material sheet, in particular a paper or cardboard sheet.

2. Discussion of Background Information

Dryer sections are generally known in the art. The material sheet is guided together with a transport belt over a number of dryer cylinders. During the removal of the material sheet from one cylinder to another, a tensile stress is necessary which, however, stretches the sheet and has a negative effect on paper quality. In addition, the danger of a sheet tearing in the subsequent areas of the dryer section, for example during smoothing and winding, is increased due to the tensile stress.

SUMMARY OF THE INVENTION

Accordingly, the present invention provides a dryer section that does not exhibit the above-noted disadvantages.

The dryer section of the present invention may include a dryer cylinder and/or sheet guide rolls over which the material sheet is guided, surrounded by threads, in particular of a screen constructed of threads, positioned between the material sheet and the surface of the dryer cylinder or the sheet guide rolls. The threads or screen facilitate the sheet removal from the dryer cylinders or sheet guide rolls in such a way that the tensile stresses on the material sheet can be significantly reduced and the afore-mentioned disadvantages can be essentially avoided.

In a preferred embodiment of the dryer section, the screen assigned to the dryer cylinder or sheet guide roll creates a closed loop, within which the dryer cylinder or sheet guide roll is positioned. Such a construction is relatively easy to build. It is also possible to fit an existing dryer section with such a loop.

In a particularly preferred embodiment of the dryer section, the threads comprise synthetic material or metal, or metal threads with synthetic material, at least on the surface facing the material sheet. It is thereby possible to increase the heat transfer from the dryer cylinder to the material sheet and/or to improve the sheet guidance.

Accordingly, the present invention is directed to a dryer section of a machine to manufacture a material sheet. The dryer section may include at least one dryer cylinder, a plurality of sheet guide rolls, a transport belt for guiding the material sheet in a meandering manner around the at least one dryer cylinder and the plurality of sheet guide rolls, and threads surrounding at least one of the at least one dryer cylinder and the plurality of sheet guide rolls. The threads may be positioned between the material sheet and a surface of the at least one of the at least one dryer cylinder and the plurality of sheet guide rolls.

In accordance with another feature of the present invention, the threads may surround the at least one of the at least one dryer cylinder and the plurality of sheet guide rolls to form a closed loop and the at least one of the at least one dryer cylinder and the plurality of sheet guide rolls may be positioned within the closed loop.

In accordance with still another feature of the present invention, a second closed loop may be formed by threads surrounding at least another one of the at least one dryer cylinder and the plurality of sheet guide rolls and at least a portion of the second closed loop being positioned next to at least a portion of the closed loop. The portion of the second closed loop may be positioned less than approximately 2 cm from the portion of the closed loop, and preferably, less than approximately 1 cm from the portion of the closed loop, and most preferably, less than approximately 0.5 cm from the portion of the closed loop. Alternatively, the portion of the second closed loop may be positioned to contact the portion of the closed loop.

In accordance with another feature of the present invention, the dryer section may further include at least one idle roll positioned within the closed loop.

In accordance with a further feature of the present invention, the at least one of the at least one dryer cylinder and the plurality of sheet guide rolls may be covered with a screen forming a closed loop.

In accordance with a still further feature of the present invention, the screen may be air-permeable and may include a coarse mesh having a width of approximately 10 mm.

In accordance with another feature of the present invention, at least the surfaces of the threads adapted to face the material sheet may include one of a synthetic material, a metal material, and a combination of metal material and synthetic material. The synthetic material may include one of polyamide and polyester.

In accordance with still another feature of the present invention, a cross-section of the threads may have one of a rectangular, trapezoidal, and oval shape. Alternatively, the threads may be composed of flat ribbon shapes. Still further, the threads may have differing cross-sectional shapes and the screen may be formed with the threads having differing cross-sectional shapes.

In accordance with a further feature of the present invention, the sheet guide rolls may be suctioned.

In accordance with still another feature of the present invention, the dryer section may include hot air hoods associated with the at least one of the at least one dryer cylinder and the plurality of sheet guide rolls.

In accordance with a still further feature of the present invention, the sheet guide rolls may be cleaned with blown air.

In accordance with another feature of the present invention, the material sheet may include one of a paper sheet and a cardboard sheet.

In accordance with a further feature of the present invention, the threads may form a screen surrounding the at least one of the at least one dryer cylinder and the plurality of sheet guide rolls.

The present invention may be directed to a dryer section in a machine for manufacturing a material sheet. The dryer section may include at least one of a dryer cylinder and a sheet guide roll and a plurality of threads surrounding a circumferential surface of the at least one of the dryer cylinder and the sheet guide roll. The plurality of threads may be adapted to contact the material sheet and to provide a separation between the circumferential surface and the material sheet.

In accordance with another feature of the present invention, the dryer section may include an idle roll positioned to be surrounded by the plurality of threads. Further, the idle roll may be adjustably positionable to adjust a tension of the plurality of threads around the at least one of the dryer cylinder and the sheet guide roll.

In accordance with still another feature of the present invention, the plurality of threads may be positioned to contact 360° of the circumferential surface.

In accordance with a further feature of the present invention, the plurality of threads may be composed of one of metal, synthetic material, and a combination of metal and synthetic material.

In accordance with yet another feature of the present invention, the at least one of the dryer cylinder and the sheet guide roll may be a dryer cylinder and the plurality of threads may be composed of a material to effect heat transfer from the circumferential surface of the dryer cylinder to surfaces of the plurality of threads adapted to contact the sheet material.

Other exemplary embodiments and advantages of the present invention may be ascertained by reviewing the present disclosure and the accompanying drawing figures.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE INVENTION

The particulars shown herein are by way of example and for purposes of illustrative discussion of the various embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

The dryer section described below is generally for the production of a material sheet. It is particularly useful for paper- and cardboard manufacturing machines. In this case, a paper-production machine is intended purely as an example and should not be construed as limited to this particular environment, rather for use in any web or sheet production machine.

Figure 1:
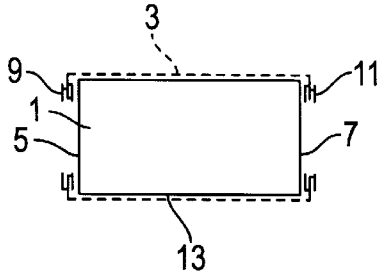
FIG. 1 illustrates s a schematic drawing of a side view of a roll.

FIG. 1 shows a side view of a roll of a dryer section in a highly schematic display, which roll may be a dryer cylinder or a sheet guide. The present example involves a dryer cylinder 1 on whose circumferential surface a screen 3 is mounted, indicated by a broken line. The screen extends over the entire length of the dryer cylinder. The screen 3 is secured in an appropriate manner on the front sides 5 and 7 of the dryer cylinder 1. On both sides, fastening- or tension-strips 9 and 11 are indicated. It is of course also possible to attach the screen 3 in the area of circumferential surface 13.

The screen 3 extends over the entire circumferential surface of the dryer cylinder 1 in such a manner that, when assembling the dryer cylinder 1 in a dryer section, the paper or material sheet, which is not displayed here, will not directly touch the circumferential surface 13. The screen 3 makes direct contact with the entire circumferential surface of the dryer cylinder 1.

Figure 2:
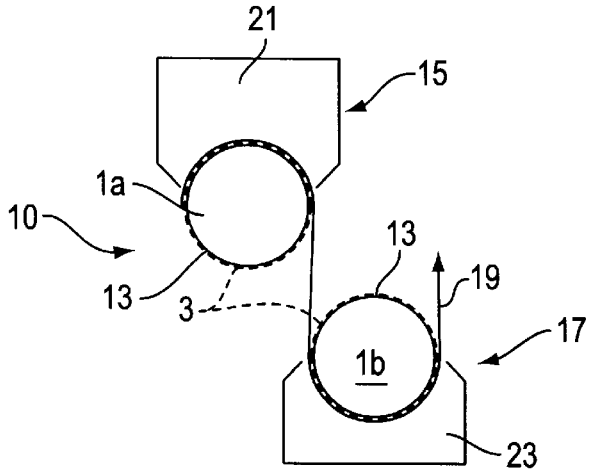
FIG. 2 illustrates a schematic drawing of part of a first embodiment of a dryer.

FIG. 2 shows part of a dryer section 10, displayed here for example as a double-row dryer section. FIG. 2 displays the last dryer cylinder 1*a* of a first dryer group 15 and the first dryer cylinder 1*b* of a second dryer group 17. The material sheet 19 is transferred from the dryer cylinder 1*a* to the dryer cylinder 1*b*. Each dryer cylinder is assigned to a hot air hood 21 or 23, by means of which material sheet 19 is exposed to hot air or hot steam as it is guided around dryer cylinders 1*a* and 1*b*.

A broken line in FIG. 2 indicates that both dryer cylinders 1*a* and 1*b* are surrounded by a screen 3, as previously shown in FIG. 1. In this regard, FIG. 2 shows that screen 3 lies directly upon the dryer cylinders 1*a* and 1*b* and surrounds their entire circumferential surface 13, in other words encompassing an area corresponding to an arc of 360°.

FIG. 2 shows that the material sheet 19 does not directly touch the circumferential surface of the dryer cylinders 1*a* and 1*b*, because in both cases, the screens 3 are designed to go between the material sheet and the surfaces of the dryer cylinders. The adhesive force between the material sheet and the surfaces of the dryer cylinders is thus reduced so much, that the removal of the material sheet 19 from the dryer cylinders becomes very easy. In particular, it is possible to reduce the tensile stress, necessary for sheet removal, which pulls in the transport direction of the sheet.

Figure 3:
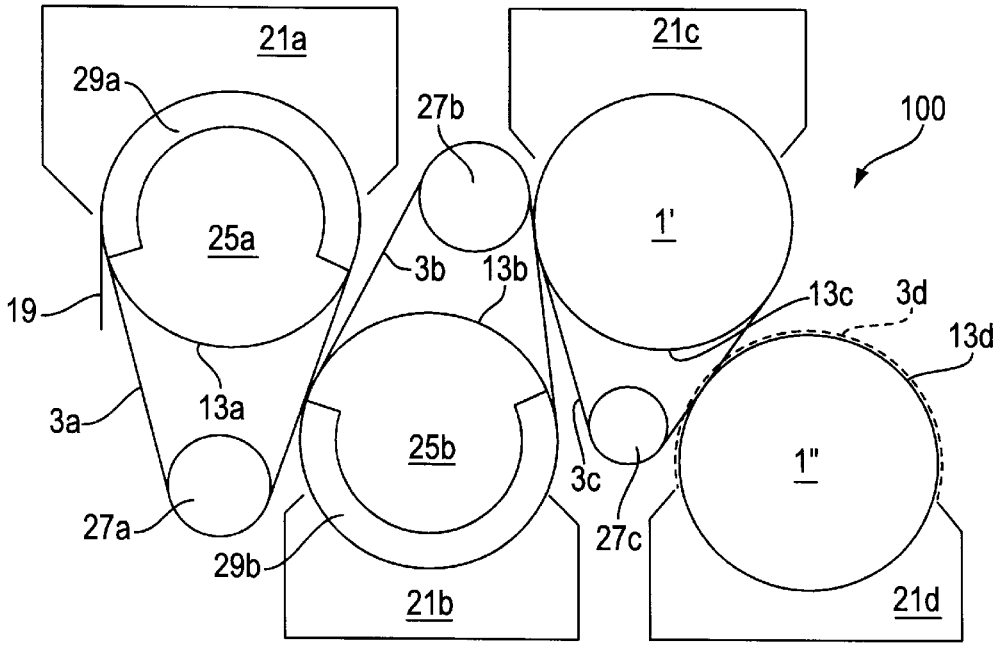
FIG. 3 illustrates a schematic drawing of part of a second embodiment of a dryer section.

Finally, FIG. 3 shows part of a dryer section 100, including a first sheet guide roll 25*a* as well as a subsequent sheet guide roll 25*b*, as seen in the transport direction of the material sheet. In addition, the dryer section 100 encompasses two dryer cylinders 1' and 1", which are subsequent to and immediately follow the sheet guide rolls. The material sheet is guided in a meandering manner first around the two sheet guide rolls 25*a* and 25*b*, and then over the dryer cylinders 1' and 1". It is of course possible to alternate the material guide rolls and the dryer cylinder.

The sheet guide rolls 25*a* and 25*b* are associated with screens 3*a* and 3*b*, which make contact with the circumferential surface of the sheet guide roll over its length but not, however, over an arc of 360°. Here, the area of contact corresponds to an arc of only about 260°. The screen 3*a* forms a closed loop within which the sheet guide roll 25*a* is positioned. In addition, an idle roll 27*a* is also positioned within the closed loop. The idle roll 27*a* is positioned here at a distance below the sheet guide roll 25*a*. This distance can be adjustable, and thus the idle roll can be used as a tension device for screen 3*a*. It is also possible to provide idle roll 27*a* with its own motor, whereby the motor of sheet guide roll 25*a* could then, if desired, be omitted.

The complete circumferential surface of sheet guide roll 25*b* also does not touch its assigned screen 3*b*. Here, too, screen 3*b* wraps around the circumferential surface 13*b* of sheet guide roll 25*b* at an angle of about 260°. The screen 3*b* also forms a closed loop in which sheet guide roll 25*b* and an idle roll 27*b*, corresponding to idle roll 27*a*, are positioned. The distance between the sheet guide roll and the idle roll can once again be adjustable.

Correspondingly, dryer cylinder 1' is associated with a screen 3*c*, forming a closed loop, within which an idle roll 27*c* is positioned in addition to dryer cylinder 1'. In the embodiment displayed here, dryer cylinder 1" is surrounded by a screen 3*d*, which completely touches the circumferential surface 13*d* of the dryer cylinder 1", in other words at an angle of 360°. From the above and from FIG. 3, it is apparent that the threads forming screens 3*a*, 3*b*, 3*c*, and 3*d* form closed loops which surround the dryer cylinder 1' and 1" as well as the sheet guide rolls 25*a* and 25*b* such that each dryer cylinder 1' and 1" and each sheet guide roll 25*a* and 25*b* is surrounded by its own closed loop.

The presence of screens 3*a*, 3*b*, 3*c*, and 3*d* ensures that material sheet 19 does not come into direct contact with surfaces 13*a*, 13*b*, 13*c*, and 13*d* of the sheet guide rolls 25*a* and 25*b* or dryer cylinders 1' and 1", thus reducing the adhesive force between the material sheet and the circumferential surfaces in such a manner that the tensile stress within the material sheet can be reduced.

The sheet guide rolls 25*a* and 25*b* are suctioned in the area of contact between material sheet 19 and the corresponding circumferential surfaces 13*a* and 13*b*, here, for example, from the interior. In this example, stationary suction devices are designed in the interior of the sheet guide rolls. Suction areas 29*a* and 29*b* have only been indicated here, since such suction devices are known. The sheet guide rolls 25*a* and 25*b* can also be suctioned in an appropriate manner from the exterior. Finally, it is also possible to suction the sheet guide rolls through their own ventilation with the aid of scrapers, which are known and therefore not shown here. From the above and from FIG. 3, the threads forming screens 3*a* and 3*b*, which may be air-permeable, contact the sheet guide rolls 25*a* and 25*b*. The sheet guide rolls 25*a* and 25*b* include suction devices 29*a* and 29*b* located adjacent to where the sceens 3*a* and 3*b* contact the sheet guide rolls 25*a* and 25*b*.

Dryer section 100 has been designed here in such a way that sheet guide rolls 25*a* and 25*b* are associated with hot air hoods 21*a* and 21*b*. Correspondingly, dryer cylinders 1' and 1" are associated with hot air hoods 21*c* and 21*d*, which serve to expose the material sheet to hot air or hot steam.

Thus, it is possible to transfer the material sheet 19 without direct contact between the circumferential surfaces of the dryer cylinders and sheet guide rolls, in single- as well as in double-row dryer sections. This basic principle can of course be upheld in subsequent treatment stations of a paper-producing machine, for example in coating units in which one or both surfaces of the material sheet receive a coating. It should be assumed that in the dryer section in particular, the material sheet 19 will be guided in a meandering manner around the dryer cylinders and/or sheet guide rolls with the assistance of transport belts, also called dryer-screens or -felts. For purposes of clarity, these transport belts are not displayed in the Figures.

The screens described with the aid of the figures may be composed of threads, which can be made of synthetic material or metal. It is also conceivable to use metal threads which have been provided or coated with synthetic material, at least on the surfaces which face the material sheet. Polyamide or polyester are the preferred synthetic materials.

It is also conceivable to combine threads with differing cross-sectional surfaces within the screen.

The threads may have a rectangular, trapezoidal, or oval cross-section. It is also possible to create flat threads, in other words ribbon-shaped. The choice of thread material, and the determination of its cross-section, can affect the heat transfer between the dryer cylinders and the material sheet and improve sheet guidance.

Finally, it is also possible to replace the screen, which as FIG. 1 shows is pulled around a dryer cylinder or sheet guide roll in the manner of a hose, or as FIG. 3 shows, forms a closed loop, with threads that surround the circumferential surface of the dryer cylinder or sheet guide rolls, ensuring that the material sheet does not directly touch the circumferential surface of the dryer cylinders and sheet guide rolls.

The air-permeability of the screens is preferably very high. Screens with a coarse mesh with openings having a width of at least about 1 cm are preferred. The screens can be cleaned by means of blown air, which can also be directed into the sheet guide rolls or their suction units, so that at times an over-pressure is exerted on the screens.

From the above it will become evident that not all dryer cylinders and/or sheet guide rolls must be surrounded by threads or screens of the type described. It is very possible that dryer cylinders and sheet guide rolls which are surrounded by threads or screens follow the usual sort of dryer cylinders and sheet guide rolls without threads and/or screens. It is thus possible to limit construction expenses to that area of the dryer section in which the removal of the material sheet from the dryer cylinders and sheet guide rolls is possible even without using threads and screens due to the given sheet characteristics.

A substantial consideration is also the fact that two neighboring sheets, especially as they were described by means of FIG. 3, are arranged in close proximity to each other, preferably touching as they run together. In this way the sheet guide rolls, idle rolls and/or dryer cylinders of neighboring loops can be arranged in direct contact with, or at a very slight distance from, each other. A distance of less than about 2 cm, preferably less than about 1 cm, is preferable. A distance of less than about 0.5 cm has proven to be especially effective.

Such an arrangement of the loops or their corresponding cylinders ensures an optimal transfer of the material sheet and avoids tensile stresses which could affect the material sheet characteristics or even result in tearing of the sheet.

It is noted that the foregoing examples have been provided merely for the purpose of explanation and are in no way to be construed as limiting the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and the spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A dryer section of a machine to manufacture a material sheet comprising:

at least one dryer cylinder;

a plurality of sheet guide rolls;

a transport belt for guiding the material sheet in a meandering manner around the at least one dryer cylinder and the plurality of sheet guide rolls, the at least one dryer cylinder and the plurality of sheet guide rolls being positioned to be capable of guiding the material sheet in a meandering manner around the at least one dryer cylinder and the plurality of sheet guide rolls;

a plurality of threads in contact with at least a portion of at least one of the at least one dryer cylinder and the plurality of sheet guide rolls;

the plurality of threads surrounding at least one of the at least one dryer cylinder and the plurality of sheet guide rolls; and the plurality of threads being positioned between the material sheet and a surface of the at least one of the at least one dryer cylinder and the plurality of sheet guide rolls.

2. The dryer section in accordance with claim 1, the plurality of threads surrounding the at least one of the at least one dryer cylinder and the plurality of sheet guide rolls forming a closed loop; and the at least one of the at least one dryer cylinder and the plurality of sheet guide rolls being positioned within the closed loop.

3. The dryer section in accordance with claim 2, a second closed loop formed by a plurality of threads surrounding at least another one of the at least one dryer cylinder and the plurality of sheet guide rolls; and at least a portion of the second closed loop being positioned next to at least a portion of the closed loop.

4. The dryer section in accordance with claim 3, the portion of the second closed loop being positioned less than approximately 2 cm from the portion of the closed loop.

5. The dryer section in accordance with claim 3, the portion of the second closed loop being positioned less than approximately 1 cm from the portion of the closed loop.

6. The dryer section in accordance with claim 3, the portion of the second closed loop being positioned less than approximately 0.5 cm from the portion of the closed loop.

7. The dryer section in accordance with claim 3, the portion of the second closed loop being positioned to contact the portion of the closed loop.

8. The dryer section in accordance with claim 2, further comprising at least one idle roll positioned within the closed loop.

9. The dryer section in accordance with claim 1, the at least one of the at least one dryer cylinder and the plurality of sheet guide rolls being covered with a screen formed by the plurality of threads, the screen forming a closed loop.

10. The dryer section in accordance with claim 9, the screen being air-permeable and comprising a coarse mesh having a width of approximately 10 mm.

11. The dryer section in accordance with claim 1, at least the surfaces of the plurality of threads adapted to face the material sheet comprises one of a synthetic material, a metal material, and a combination of metal material and synthetic material.

12. The dryer section in accordance with claim 11, the synthetic material comprising one of polyamide and polyester.

13. The dryer section in accordance with claim 1, a cross-section of the threads having one of a rectangular, trapezoidal, and oval shape.

14. The dryer section in accordance with claim 1, the plurality of threads being composed of flat ribbon shapes.

15. The dryer section in accordance with claim 9, the plurality of threads having differing cross-sectional shapes; and the screen being formed with the plurality of threads having differing cross-sectional shapes.

16. The dryer section in accordance with claim 1, the sheet guide rolls being suctioned.

17. The dryer section in accordance with claim 1, further comprising hot air hoods associated with the at least one of the at least one dryer cylinder and the plurality of sheet guide rolls.

18. The dryer section in accordance with claim 1, wherein the sheet guide rolls are cleaned with blown air.

19. The dryer section in accordance with claim 1, the material sheet comprising one of a paper sheet and a cardboard sheet.

20. The dryer section in accordance with claim 1, the plurality of threads forming a screen surrounding the at least one of the at least one dryer cylinder and the plurality of sheet guide rolls.

21. A dryer section in a machine for manufacturing a material sheet comprising:

at least one of a dryer cylinder and a sheet guide roll;

a plurality of threads in contact with at least a portion of at least one of the dryer cylinder and the sheet guide roll;

the plurality of threads surrounding a circumferential surface of the at least one of the dryer cylinder and the sheet guide roll; and the plurality of threads adapted to contact the material sheet and to provide a separation between the circumferential surface and the material sheet.

22. The dryer section in accordance with claim 21, further comprising an idle roll positioned to be surrounded by the plurality of threads.

23. The dryer section in accordance with claim 22, the idle roll being adjustably positionable to adjust a tension of the plurality of threads around the at least one of the dryer cylinder and the sheet guide roll.

24. The dryer section in accordance with claim 21, the plurality of threads positioned to contact 360° of the circumferential surface.

25. The dryer section in accordance with claim 21, the plurality of threads being composed of one of metal, synthetic material, and a combination of metal and synthetic material.

26. The dryer section in accordance with claim 21, the at least one of the dryer cylinder and the sheet guide roll comprising a dryer cylinder; and the plurality of threads being composed of a material to effect heat transfer from the circumferential surface of the dryer cylinder to surfaces of the plurality of threads adapted to contact the sheet material.

27. The dryer section in accordance with claim 1, the plurality of threads forming closed loops which surround each of the at least one dryer cylinder and the plurality of sheet guide rolls such that each of the at least one dryer cylinder and the plurality of sheet guide rolls is surrounded by its own closed loop.

28. The dryer section in accordance with claim 1, the plurality of threads forming at least one air-permeable screen in contact with at least one of the plurality of sheet guide rolls, the at least one of the plurality of sheet guide rolls comprising at least one suction device located adjacent to where the air-permeable screen contacts the at least one of the plurality of sheet guide rolls.

29. The dryer section in accordance with claim 21, the at least one of the dryer cylinder and the sheet guide roll comprising at least one dryer cylinder and at least one sheet guide roll being positioned to be capable of guiding the material sheet in a meandering manner around the at least one dryer cylinder and the at least one sheet guide roll.

30. The dryer section in accordance with claim 21, the plurality of threads forming closed loops which surround each of the at least one of the dryer cylinder and the sheet guide roll such that each of the at least one of the dryer cylinder and the sheet guide roll is surrounded by its own closed loop.

31. The dryer section in accordance with claim 21, the plurality of threads forming at least one air-permeable screen in contact with the sheet guide roll, the sheet guide roll comprising a suction device located adjacent to where the air-permeable screen contacts the sheet guide roll.

* * * * *